United States Patent [19]

Rushing

[11] Patent Number: 4,788,995

[45] Date of Patent: Dec. 6, 1988

[54] UMBRELLA ASSEMBLY

[76] Inventor: Ronald A. Rushing, 6305 S. 145th St., Omaha, Nebr.

[21] Appl. No.: 105,333

[22] Filed: Oct. 7, 1987

Related U.S. Application Data

[63] Continuation of Ser. No. 888,945, Jul. 24, 1986, abandoned.

[51] Int. Cl.[4] ..... A45B 3/00

[52] U.S. Cl. ..... 135/16; 135/DIG. 10

[58] Field of Search ..... 135/16, 66, DIG. 10

[56] References Cited

U.S. PATENT DOCUMENTS

| | | | |
|---|---|---|---|
| 1,166,272 | 12/1915 | Smithing | 135/DIG. 10 |
| 1,177,241 | 3/1916 | Gay | 135/DIG. 10 |
| 1,574,623 | 2/1926 | Grau | 135/DIG. 10 |
| 2,878,366 | 3/1959 | Evans | 135/DIG. 10 |
| 3,281,586 | 10/1966 | Gonzalez | 135/DIG. 10 |

*Primary Examiner*—J. Karl Bell

*Attorney, Agent, or Firm*—Kinzer, Plyer, Dorn, McEachran & Jambor

[57] ABSTRACT

This is concerned with an umbrella assembly and specifically with one that has a flashlight assembly in the handle thereof socketed so that operation of the flashlight is assured. The flashlight is a self-contained unit so that it may be replaced from time to time when the battery or batteries are worn out. The flashlight projects through the end of the handle and is useful in finding keyholes in the dark, aiding a woman in rummaging through her purse and the like. The flashlight can also be operated when the umbrella canopy is fully extended to project a light downwardly so a person walking in the dark can see steps, obstacles, etc.

2 Claims, 1 Drawing Sheet

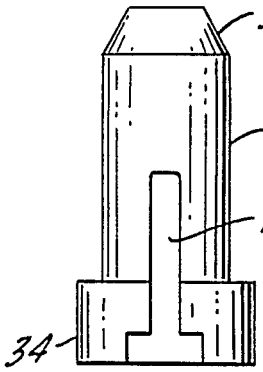
Fig. 4.
Fig. 5.
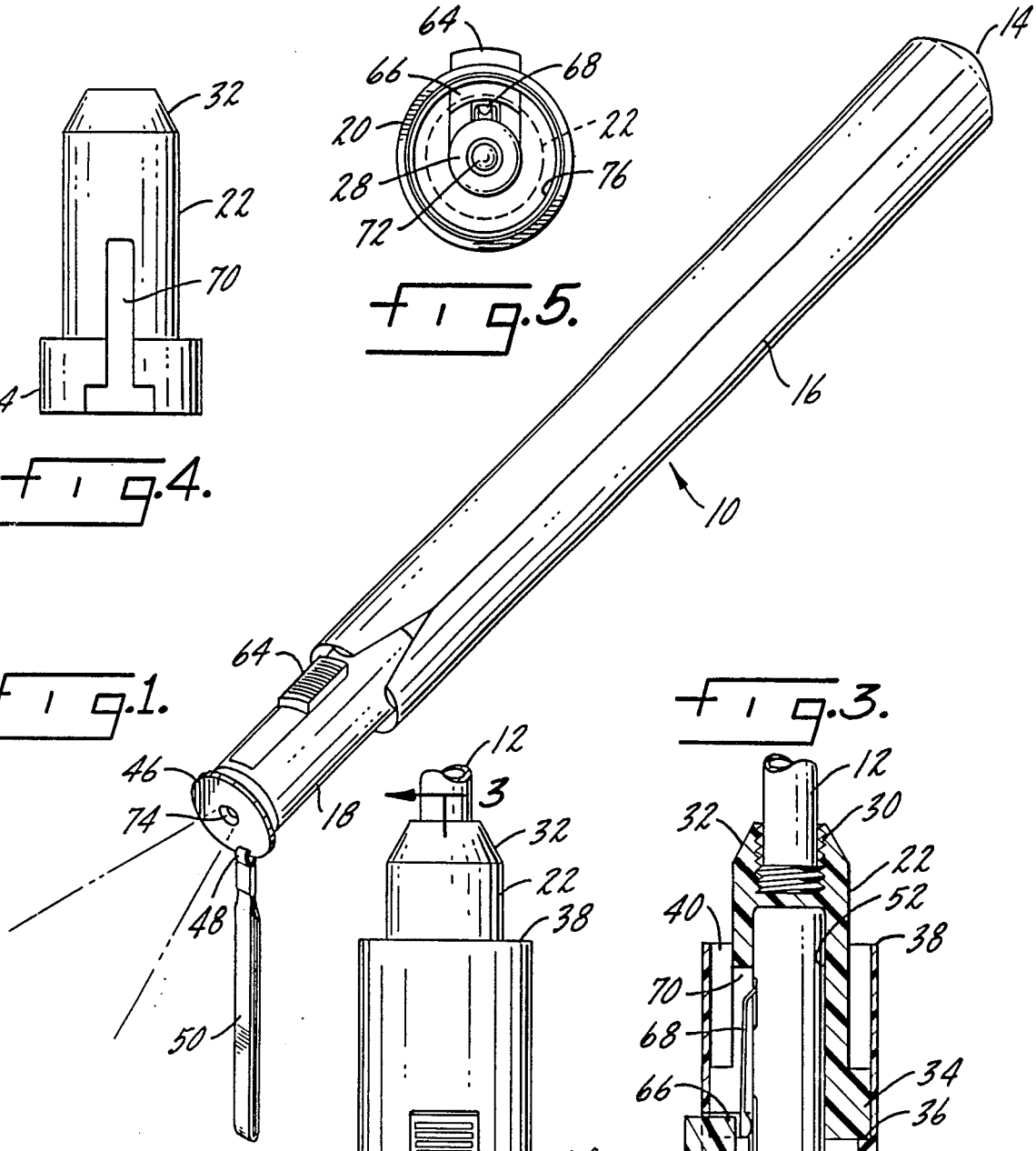
Fig. 1.
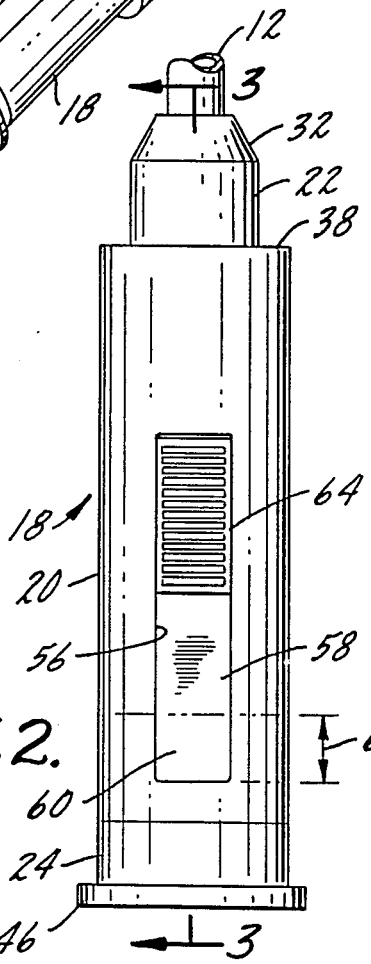
Fig. 2.
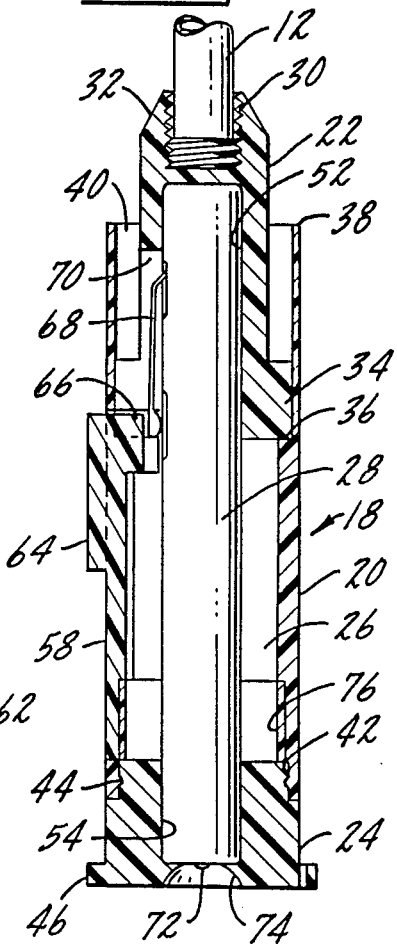
Fig. 3.

UMBRELLA ASSEMBLY

This is a continuation of application Ser. No. 888,945 filed Jul. 24, 1986, now abandoned.

SUMMARY OF THE INVENTION

This invention is concerned with an umbrella assembly and specifically with an umbrella that has a flashlight in the handle.

A primary object of the invention is a combination umbrella and flashlight to enable the user, for example, to find a keyhole in the dark.

Another object is an umbrella assembly of the above type which assists in finding items in a purse in the dark, such as loose change, keys, etc., and also assist in getting in and out of a car.

Another object is an umbrella assembly of the above type which contains a self-contained flashlight in the handle so that when the batteries are exhausted, the entire flashlight can be replaced.

Another object is an alignment structure in the handle of an umbrella of the above type which ensures proper mounting of a self-contained flashlight.

Another object is an inexpensive handle assembly for an umbrella which contains a flashlight.

Other objects will appear from time to time in the ensuing specification and drawings.

BRIEF DESCRIPTION OF THE DRAWINGS

FIG. 1 is a perspective of the umbrella assembly;

FIG. 2 is an enlarged view of the handle;

FIG. 3 is a section along line 3—3 of FIG. 2, with the parts in full;

FIG. 4 is a side view of a part; and

FIG. 5 is an end view of the handle with the bottom or closure removed.

BRIEF DESCRIPTION OF THE PREFERRED EMBODIMENT

The umbrella assembly is indicated generally at 10 and includes a shaft 12 with a conventional umbrella canopy mounted at one end 14, shown in FIG. 1 as enclosed by a cover 16, and a handle assembly 18 at the other end.

The handle assembly includes an outer housing 20 which is more or less in the form of a tube closed at its upper end by a fitting 22 and at its lower end by a closure 24 to thereby provide a cavity or chamber 26 in the handle.

A self-contained flashlight assembly 28 is disposed or positioned in the cavity in the handle and, in the form shown, may be of the type that is commonly referred to as a penlight flashlight, meaning a self-contained disposable unit intended to be thrown away when the batteries are exhausted. This is not to say that other types of flashlights could not be used however.

The fitting 22 closing the upper end of the housing is shown separately in FIG. 4 and includes, as shown in FIG. 3 a threaded socket 30 at its upper end into which the umbrella shaft screws. The socket is in the form of a blind hole so that the shaft may bottom therein and be tightly mounted without any extra connectors, such as screws, bands or what have you. The particular mounting, however, of the umbrella shaft to the handle may take other forms and the particular arrangement shown is convenient, reliable and inexpensive.

The adapter or fitting 22 may be tapered as at 32 on its upper end and has an outstanding flange or enlargement 34 on its lower end which fits into the open tubular end of the housing 20. It will be noted in FIG. 3 that the enlargement 34 of the adapter bottoms against a shoulder 36 provided by different diameters inside the housing with the shoulder being a given distance from the open end 38 of the housing to provide an annular countersink or recess 40 into which the ends or tips of the umbrella canopy support ribs may extend as a unit when the umbrella is fully collaped and compressed to its minimum length which is the position shown in FIG. 1.

The bottom closure 24 on the handle is shown as a separate piece which is socketed at 42 into the end of the housing and may have a snap ring and groove interfit 44 to hold it tightly and rigidly in place. The end closure 24 may have an enlargement or flange 46 at the end to provide a connection 48 for a lanyard or loop 50 shown in FIG. 1.

The fitting 22 at the upper end has a socket 52 into which the flashlight fits as does the end closure 24, as at 54. The dimensioning is such that with the flashlight in place and all of the parts fully assembled, the flashlight is socketed at each end and is held rigidly and securely in the handle.

The side of the housing or handle is provided with an elongated slot 56 in which a depressible element 58 is mounted. The depressible element is elongated so that it complements or fits in the slot and is attached at one end 60 by gluing or heat sealing the periphery thereof in the slot for a certain distance as at 62. The other end of the depressible element may have an enlargement or raised portion 64 and an inner protruberance 66 to operate the flashlight. The depressible element in a sense is cantilevered about one end with the depressible portion at the other end being within the hand of the user handling the umbrella. The extent 62 of the connected portion should be such that a balance is struck between the depressible portion being too hard to operate on the one hand and too easy, on the other, which would cause the flashlight to be energized inadvertently.

The flashlight assembly 28 may have an activator clip 68 as an integral part thereof. The fitting 22 may have a slot 70 formed therein so that when the flashlight assembly 28 is inserted into the open end of the handle, the activator clip 68 must be aligned with the slot 70 to obtain proper mounting of the flashlight. The slot 70 is also aligned with the depressible element 58 so that the end of the activator clip 68 is aligned with the depressible element when the unit is fully assembled, as shown in FIG. 3. It will be understood that the flashlight is of the type in which depression of the activator clip causes the flashlight to operate although it might be otherwise. The light 72 of the flashlight assembly is on the end thereof and is opposite a suitably shaped opening 74 in the removable end closure 24.

If desired, a mounting band 76 may be forced or swedged into the end of the housing as shown in FIG. 3 to serve as a backup for mounting the depressible element 58. This is to say that in addition to connecting the depressible element to the housing about its periphery in the distant 62, the inner surface of the depressible element may also be glued or otherwise connected to the band 76 if desired.

The use, operation and function of the invention are as follows:

The invention is concerned with an umbrella assembly which may be viewed as a combination umbrella and flashlight. The flashlight is positioned in the handle so that it may be easily and conveniently activated whether or not the umbrella canopy is up or down. It is anticipated that the main use or utility of the flashlight will be when the umbrella is down and the user is in the dark, for example to aid in finding the keyhole in a door or when looking for loose change, etc. in a purse or briefcase. It may be also quite useful to aid in getting in and out of a car in the dark.

It is also anticipated that the flashlight will be useful when the umbrella is raised, for example to illuminate the ground for obstacles such as steps, etc. in the dark when it is raining. It will be noted that the umbrella could be held in a normal upright position by one hand and the flashlight energized without any extra manipulation other than squeezing the handle.

The specific arrangement shown has the advantage that a separate totally contained flashlight can be mounted in the handle and thrown away and replaced when the batteries are exhausted. The mounting also has the advantage that the flashlight assembly is rigidly socketed at each end and that the exterior depressible element is automatically aligned with the activator clip when the unit is assembled.

While the preferred form and several variations of the invention have been shown and suggested, it should be understood that suitable additional modifications, changes, substitutions and alterations may be made without departing from the invention's fundamental theme. It is therefore wished that the invention be unrestricted except as by the appended claims.

I claim:

1. In an umbrella assembly, a shaft with a collapsible umbrella canopy at one end and a handle at the other, a cavity in the handle, a unitary flashlight assembly in the cavity and having a depressible activator element on the exterior thereof, an axial slot on the inside of the cavity for receiving the depressible activator element of the flashlight assembly to provide guidance and orientation to the flashlight assembly when it is inserted, as a unit, into the cavity, an opening in the end of the handle aligned with the light of the flashlight assembly, an elongated slot on the outside of the handle opening through the inside into the cavity in longitudinal alignment with the inside axial slot, a depressible element in the elongated slot conforming generally thereto in its peripheral outline and being disposed therein, one end of the depressible element being integrally connected to the handle so that it cantilevers when depressed on the outside in a direction lateral to the handle so that, upon depression of the depressible element, the depressible activator element will be depressed and the flashlight assembly will be energized, and a mounting for the flashlight assembly that centers the activator element under the depressible element when the flashlight assembly is fully inserted.

2. The structure of claim 1 further characterized by and including a closure on the end of the handle, the opening in the end of the handle being in the closure, and sockets at each end of the cavity for receiving and positioning the flashlight assembly, one of the sockets being in the closure element.

* * * * *